US010124471B2

(12) United States Patent
Sturner

(10) Patent No.: US 10,124,471 B2
(45) Date of Patent: Nov. 13, 2018

(54) BOAT DRAIN PLUG WRENCH

(71) Applicant: Sturner Group, Inc., Riverside, CA (US)

(72) Inventor: Robert Martin Sturner, Riverside, CA (US)

( * ) Notice: Subject to any disclaimer, the term of this patent is extended or adjusted under 35 U.S.C. 154(b) by 14 days.

(21) Appl. No.: 15/348,788

(22) Filed: Nov. 10, 2016

(65) Prior Publication Data

US 2017/0232585 A1 Aug. 17, 2017

Related U.S. Application Data

(60) Provisional application No. 62/255,246, filed on Nov. 13, 2015.

(51) Int. Cl.

| | |
|---|---|
| ***B25B 13/48*** | (2006.01) |
| ***B25B 23/16*** | (2006.01) |
| ***B25B 23/00*** | (2006.01) |
| ***B25G 1/10*** | (2006.01) |
| ***B25B 13/06*** | (2006.01) |
| ***B25B 13/50*** | (2006.01) |

(52) U.S. Cl.

CPC ..... *B25B 23/0035* (2013.01); *B25B 13/06* (2013.01); *B25B 13/065* (2013.01); *B25B 13/5091* (2013.01); *B25G 1/10* (2013.01)

(58) Field of Classification Search

CPC .. B25G 1/10; B25B 1/16; B25B 13/06; B25B 13/065; B25B 13/5019

USPC ..... 81/125

See application file for complete search history.

(56) References Cited

U.S. PATENT DOCUMENTS

| | | | | |
|---|---|---|---|---|
| 3,738,768 | A * | 6/1973 | Kuhn | B25B 13/44 279/42 |
| D271,937 | S * | 12/1983 | Combs | 16/421 |
| D317,705 | S * | 6/1991 | Tinz | D8/307 |
| 5,297,458 | A * | 3/1994 | Smith | B25B 13/06 81/124.2 |
| 6,240,611 | B1 * | 6/2001 | Chase | B25B 27/30 29/228 |
| 6,347,450 | B1 * | 2/2002 | Langlois | B25B 27/10 29/747 |
| 6,354,176 | B1 * | 3/2002 | Nordlin | B25B 13/06 81/121.1 |
| 6,698,317 | B1 * | 3/2004 | Machovsky | B25B 13/02 81/124.2 |
| 7,055,412 | B2 * | 6/2006 | Leighton | B25B 13/06 81/124.4 |
| 8,701,526 | B2 * | 4/2014 | Scott | B25B 13/065 29/426.5 |

* cited by examiner

*Primary Examiner* — Hadi Shakeri
(74) *Attorney, Agent, or Firm* — Benjamin Diederich

(57) ABSTRACT

A device for removing a boat drain plug, having a body with a distal end and a proximal end. The distal end has a first square-shaped opening configured to engage a boat drain plug. The first square-shaped opening features a first notch extending outward from one side and a second notch extending outwardly from a diametrically opposed side. The proximal end has a first handle extending laterally outward from the body, a second handle diametrically opposed to the first handle and extending laterally outward from the body, and a second square-shaped opening disposed between the first handle and the second handle. The second square-shaped opening is configured to engage a socket wrench.

5 Claims, 3 Drawing Sheets

BOAT DRAIN PLUG WRENCH

CROSS-REFERENCE TO RELATED APPLICATIONS

This application claims the benefit of U.S. Provisional Application No. 62/255,246, filed on Nov. 13, 2015, titled WRENCH, the teachings of which are expressly incorporated by reference.

STATEMENT RE: FEDERALLY SPONSORED RESEARCH/DEVELOPMENT

Not Applicable

BACKGROUND

1. Field of the Invention

The present disclosure relates generally to a wrench for removing boat drain plugs.

2. Description of the Prior Art

Recreational boats are typically designed with at least one drain hole and drain plug system to allow for quick removal of water from the boat when out of water for trailering or dry storage. Due to the increasing rise in invasive waterborne pests, such as the quagga mussel, and the transfer of plant life and other non-native species between bodies of water, boaters are often now directed to remove the drain plug from the boat once it is removed from water. Consequently, the plug must be again reinserted into the drain hole before launching the boat again. Drain plugs are typically fashioned from non-corrosive metal with a square end to allow for removal with standard wrenches. The square head may either be a Standard or Metric size. Alternatively, some drain plugs have a T-handle configuration to allow for removal.

Boat drain plugs are typically positioned below the boat in hard to reach locations. As such, it can be difficult to maneuver standard wrenches, or the users hands to get to the drain plug. Furthermore the surrounding space can be small, allowing for very little turning of the wrench before it must be refitted on the plug to continue turning the plug for removal or reinsertion.

As such, there is a need for a tool that will work with different types of drain plug heads, allows for easy insertion in to tight areas, and will allow for continual turning of the plug without having to repeatedly reattach the tool to the plug.

BRIEF SUMMARY

In accordance with one embodiment of the present disclosure, there is contemplated a device for removing a boat drain plug. The device includes a body having a distal end and a proximal end opposite said proximal end.

The distal end has a first square-shaped opening configured to engage a boat drain plug. Further, the first square-shaped opening features a first notch extending outward from one side of the first square-shaped opening and a second notch extending outwardly from a diametrically opposed side of the first square-shaped opening.

The proximal end has a first handle extending laterally outward from the body, a second handle diametrically opposed to the first handle and extending laterally outward from the body, and a second square-shaped opening disposed between the first handle and the second handle. The second square-shaped opening is configured to engage a socket wrench.

The first square-shaped opening may be 9/16 inch. The first square-shaped opening may be 15 mm. The second square-shaped opening may be 3/8 inch. The first square-shaped opening may be a lobed opening to allow for use of the device with differently sized boat drain plugs. For example, the lobed opening may allow the same device to remove both 9/16 inch and 15 mm drain plugs.

The device may further include at least one hole extending through one of the first and second handles to allow for ease of handing the device.

For ease of use, the first handle may be convexly shaped and the second handle may be concavely shaped.

To add to the overall strength of the device when in use, it may further include a flange running along an outer border of the first handle and the second handle.

The body of the device may be formed from various materials, including a plastic polymer.

In accordance with another embodiment of the present disclosure, the device for removing a boat drain plug may have a body having a distal end and a proximal end opposite said proximal end. The distal end has a first square-shaped opening configured to engage a boat drain plug. The proximal end has a first handle extending laterally outward from the body and a second handle diametrically opposed to the first handle and extending laterally outward from the body. The first square-shaped opening may be 9/16 inch or 15 mm.

The device of this embodiment may further include a first notch extending outward from one side of the first square-shaped opening and a second notch extending outwardly from a diametrically opposed side of the first square-shaped opening. Additionally, or alternatively, the first square-shaped opening may be a lobed opening.

The device of this embodiment may further include a second square-shaped opening disposed between the first handle and the second handle. The second square-shaped opening may be configured to engage a socket wrench. The second square-shaped opening may be 3/8 inch. In the device of this embodiment, the first handle may be convexly shaped and the second handle may be concavely shaped. Furthermore, the device may further include a flange running along an outer border of the first handle and the second handle. Additionally, the body may be formed from a plastic polymer. The device may further include at least one hole extending through one of the first and second handles.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
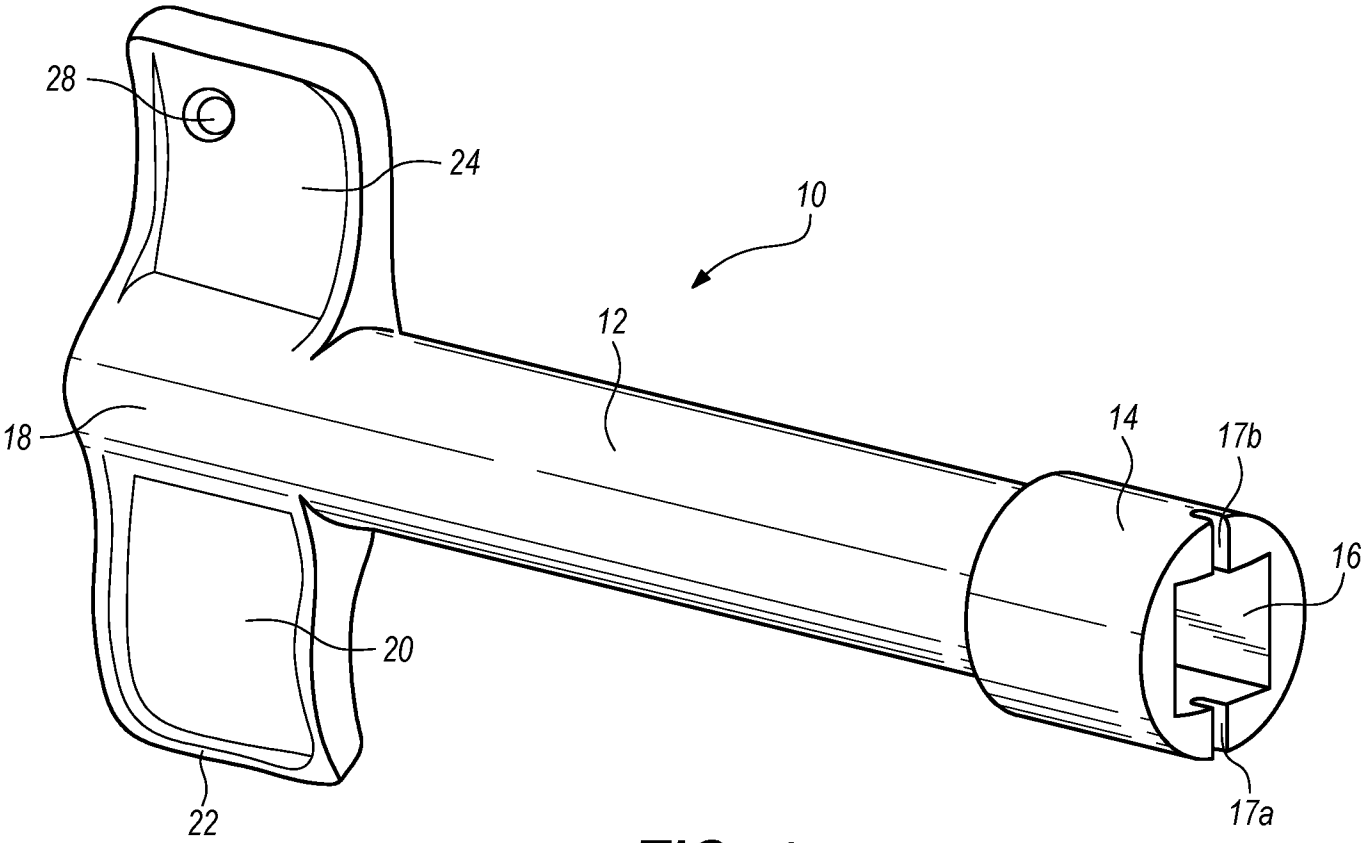
FIG. 1 is a perspective view of the front side of the boat drain plug wrench of the present disclosure.

As shown in FIG. 1, the present disclosure envisions a boat drain plug wrench 10. The wrench 10 comprises an elongated body portion 12 that is centrally located on the wrench 10 and extends along its length. The elongated body portion 12 is cylindrically shaped and of sufficient length to allow for proper distance between the wrench user and the boat drain plug, for comfortable use.

At a distal end 14 of the body portion 12, there is formed a first square-shaped opening 16 capable of receiving a boat drain plug. The distal end 14 may be of a wider circumference than the rest of the body portion 12 to properly size the square opening 16, and to provide further strength to the wrench 10 at the working site.

As the first square-shaped opening 16 is sized to accommodate the most common boat drain plugs, it may be a 9/16" opening. Alternatively, the first square-shaped opening 16 may be 15 mm. Further, the first square opening 16 may have a first notch 17*a* extending outward from one side, and a second notch 17*b* extending outwardly from a diametrically opposed side of the first square opening 16. The two notches 17*a,b* allow for the wrench 10 to be used with T-handle drain plugs as well as the square bolt head plugs previously discussed. The notches 17*a,b* may be sized at approximately 0.1 to 0.125 inches.

At a proximal end 18 of the body portion 12, there is integrally formed a first handle 20 extending laterally outward from the body 12. The first handle 20 may be of a generally square shape, but is thinner than the body portion 12. The first handle 20 is convexly shaped and features a flange 22 running along the outside of its three sides that are not attached to the body 12 to provide additional strength to the wrench 10 during use.

Extending outwardly from the proximal end 18, and diametrically opposed to the first handle 20, is a second handle 24. The second handle 24 has the same general size and configuration as the first handle 20, but is instead concavely shaped.

Figure 2:
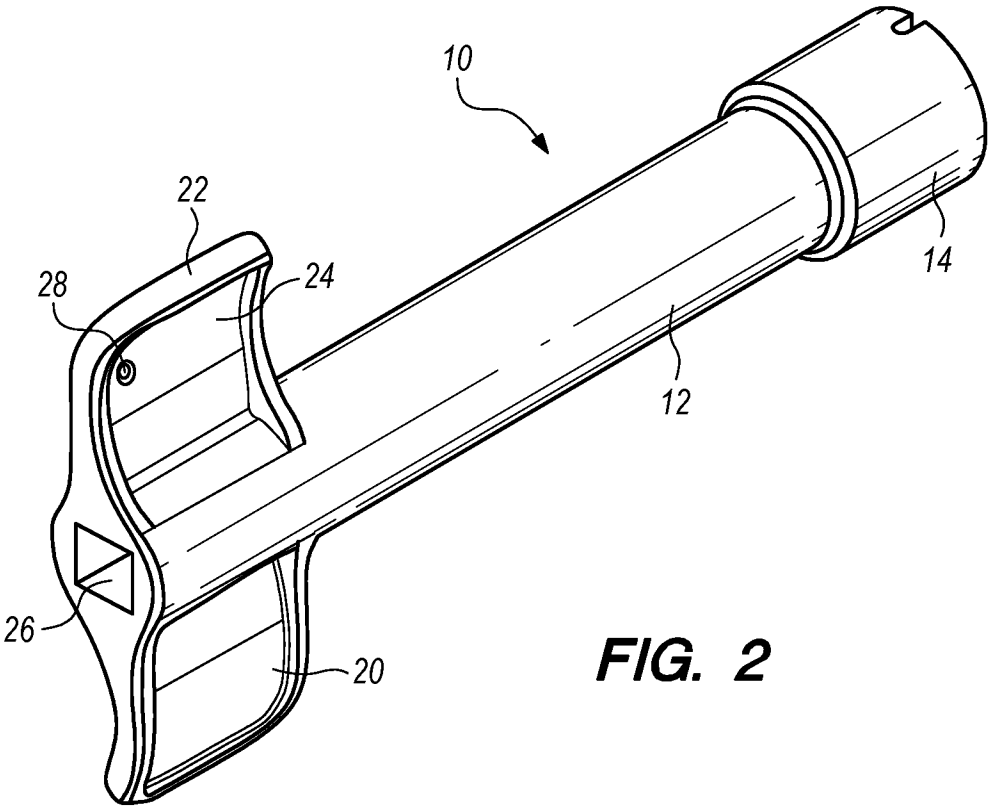
FIG. 2 is a perspective view of the rear side of the boat drain plug wrench shown in FIG. 1.

As shown in FIG. 2, disposed between the first handle 20 and the second handle 24 may be a second square-shaped opening 26 facing axially outward. The second square opening 26 is configured to receive the male portion of a standard socket wrench to allow the wrench 10 to act as an extended socket. The second square opening 26 may be a 3/8" opening.

One of the handles may include at least one hole 28 extending therethrough to allow for easy hanging of the wrench 10 when not in use.

The wrench 10 can be formed out of any suitable material capable of providing the necessary rigidity necessary to withstand the intended use. In particular, the wrench 10 can be formed of plastic polymers, wood, or metal. Preferably it is formed from a corrosion resistant material that is capable of floating. As such, a hard plastic polymer is a preferred material. Even more preferably, the wrench 10 is formed from a plastic polymer infused with fiberglass.

While the dimensions of the overall wrench are not critical, in one embodiment the length of the wrench 10 from the far proximal end to the far distal end is approximately six inches. In this embodiment, the distal end 14 may be approximately one inch long. Further, in this embodiment, the span from the edge of the first handle 20 to the edge of the second handle 24 is approximately three inches.

Figure 3:
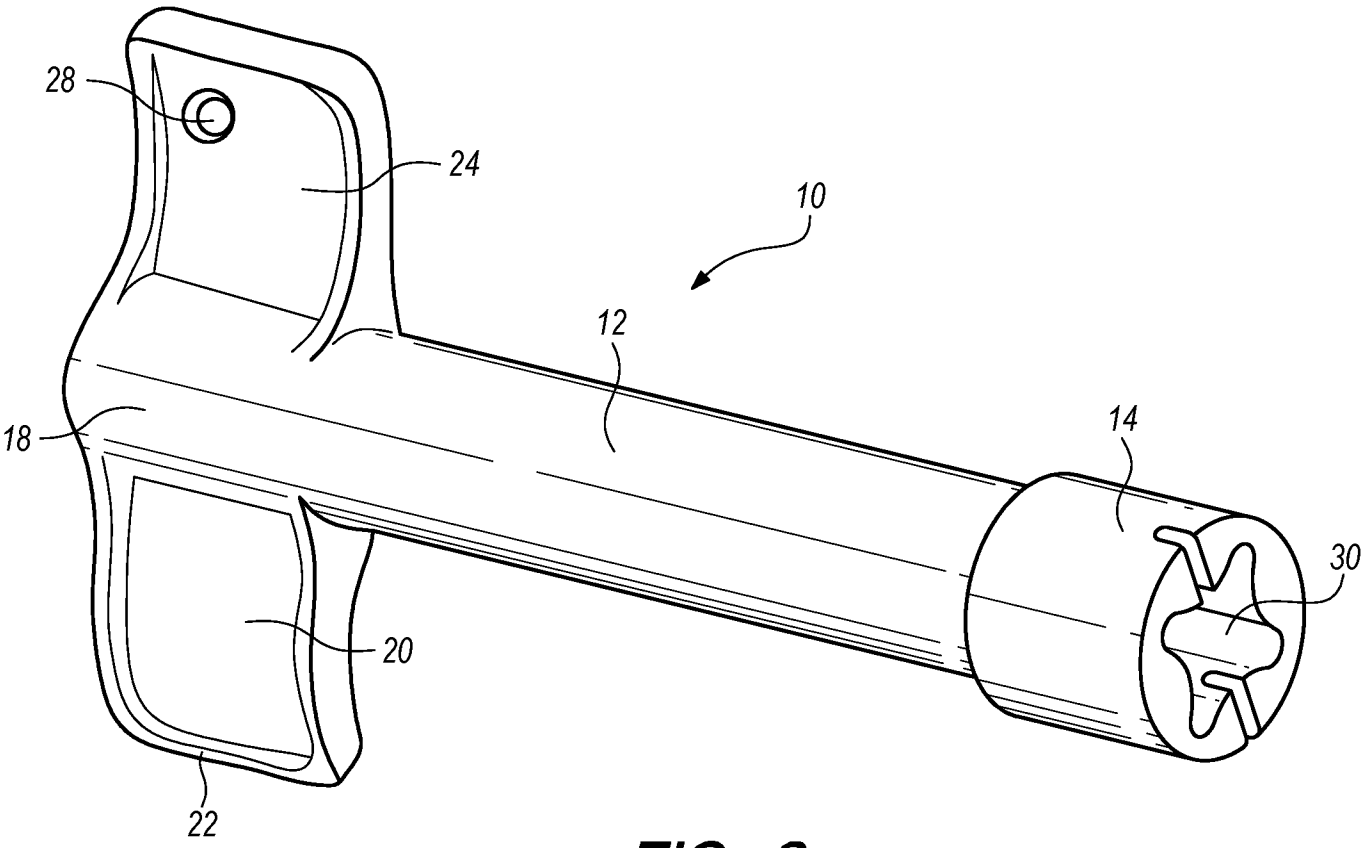
FIG. 3 is a perspective view of the front side of an alternate embodiment of the boat drain plug wrench.

Shown in FIG. 3 is an alternative embodiment of the wrench 10 capable of being properly used with both common boat drain plugs, that is, 9/16" and 15 mm. In this embodiment, rather than using a strict square opening, it features a lobed square opening 30. By changing the geometry of the square, the lobed opening 30 allows the two different drain plug sizes to seat against different faces of the opening, thereby working to remove either.

The above description is given by way of example, and not limitation. Given the above disclosure, one skilled in the art could devise variations that are within the scope and spirit of the invention disclosed herein, including the use of various different materials to form the wrench. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A device for removing a boat drain plug comprising:

a body having a distal end and a proximal end opposite said proximal end;

the distal end comprising a first lobed opening configured to engage a boat drain plug, wherein the first lobed opening is configured with a 9/16 inch opening and a 15 mm opening, the first lobed opening further comprises a first notch extending outward from one side of the first lobed opening and a second notch extending outwardly from a diametrically opposed side of the first lobed opening;

the proximal end comprising a first convexly-shaped handle extending laterally outward from the body, a second concavely-shaped handle diametrically opposed to the first handle and extending laterally outward from the body, and a second square-shaped opening disposed between the first handle and the second handle, wherein the second square-shaped opening is configured to engage a socket wrench.

2. The device of claim 1, wherein the second square-shaped opening is 3/8 inch.

3. The device of claim 1, further comprising at least one hole extending through one of the first and second handles.

4. The device of claim 1, further comprising a flange running along an outer border of the first handle and the second handle.

5. The device of claim 1, wherein the body is formed from a plastic polymer.

* * * * *